United States Patent [19]

Reed et al.

[11] Patent Number: 4,741,395

[45] Date of Patent: May 3, 1988

[54] VENT-WELL SYSTEM

[76] Inventors: Robert W. Reed, 19560 Visale St.; Thomas L. Jacobs, 207 Alabama St., both of Huntington Beach, Calif. 92648

[21] Appl. No.: 939,786

[22] Filed: Dec. 8, 1986

[51] Int. Cl.[4] ..... E21B 33/03; E02B 15/04

[52] U.S. Cl. ..... 166/81; 405/60

[58] Field of Search ..... 166/67, 81, 93; 405/60, 405/128, 129, 210

[56] References Cited

U.S. PATENT DOCUMENTS

| | | | |
|---|---|---|---|
| 1,830,061 | 11/1931 | Howe | 405/60 |
| 3,322,198 | 5/1967 | McHenry | 166/81 |
| 4,358,218 | 11/1982 | Graham | 405/60 |
| 4,395,157 | 7/1983 | Cunningham | 405/60 |
| 4,405,258 | 9/1983 | O'Rourke et al. | 405/60 |
| 4,416,565 | 11/1983 | Ostlund | 405/60 |
| 4,421,436 | 12/1983 | Burns | 405/60 |
| 4,464,081 | 8/1984 | Hillier et al. | 405/128 |
| 4,483,641 | 11/1984 | Stoll | 405/129 |
| 4,531,860 | 7/1985 | Barnett | 405/60 |

*Primary Examiner*—Stephen J. Novosad
*Assistant Examiner*—William P. Neuder
*Attorney, Agent, or Firm*—Grant L. Hubbard

[57] ABSTRACT

A capped oil or gas well comprising the top of the well casing disposed beneath the surface of the earth, a sealing on the top of the well casing, a frusto-conical collector constructed of upwardly converging walls over and surrounding the top of the well casing, and a conduit connected to and in fluid communication with the top of the frusto-conical collector extending to a point above the earth for discharging collected gases is disclosed.

7 Claims, 2 Drawing Sheets

VENT-WELL SYSTEM

FIELD OF THE INVENTION

This invention relates to methods and systems for sealing off oil and gas wells and for using abandoned oil and gas fields.

BACKGROUND OF THE INVENTION

In some parts of the country, particularly in California, Texas and Louisiana, and in some parts of Wyoming and Pennsylvania, once productive gas wells and oil wells and entire oil and gas fields have been abandoned. In some instances, these oil and gas fields lie in highly developed areas and the land values are very high. Often, especially in Southern California, the land values are extremely high because these tracts of land, often quite large, are prime sources for commercial and residential development. Development of these valuable pieces of real estate has, however, been severally impeded, and in some cases there have been catastrophic results of developing these pieces of land. For example, in one particular striking incident, the lawn and garden areas around a shopping center complex simply burst into flames without advance warning. It was discovered that these structures had been developed over abandoned oil wells which had not been properly capped off, and over the years the ground had become saturated with methane and other natural gases, which constantly escape from these oil wells in a greater or lesser degree. The concentration of methane built up to the point where it became combustible and was ignited, apparently, by a spark in one of the electrical systems.

One of the currently used techniques for capping off oil wells is to dig down several feet, sometimes up to fifty (50) feet or more, surround the casing with concrete and fill the casing with concrete and then weld off the top of the casing with a steel plate. This method is of limited effectiveness and is extremely expensive. The present invention may be used as an increased safety factor in connection with the previously used methods of venting off oil wells.

SUMMARY OF THE INVENTION

The invention comprises a system for venting off oil wells and gas wells to permit the development of the real estate lying above the abandoned oil or gas well.

The invention also comprises a structure for venting off oil and gas wells in a safe and effective manner.

A system is disclosed which includes a frustoconical collector filled with loose gravel disposed over and around an abandoned oil well casing and a conduit for permitting the gradual escape of methane and other gases harmlessly into the air.

DESCRIPTION OF THE PREFERRED EMBODIMENT

Figure 1A:
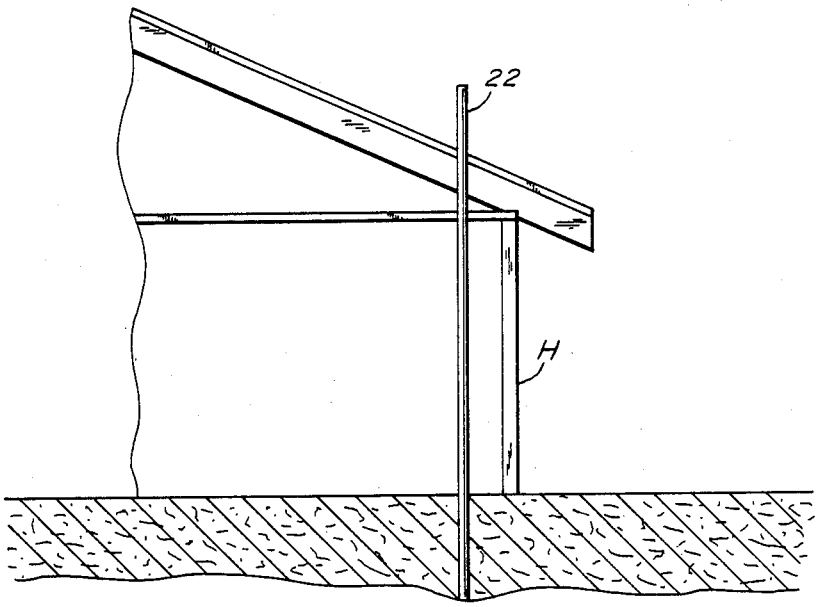
FIG. 1A shows the surface portion of a system according to this invention, depicting a house and a vent pipe extending up through the house for venting methane above the roof in a safe manner.
Figure 1B:
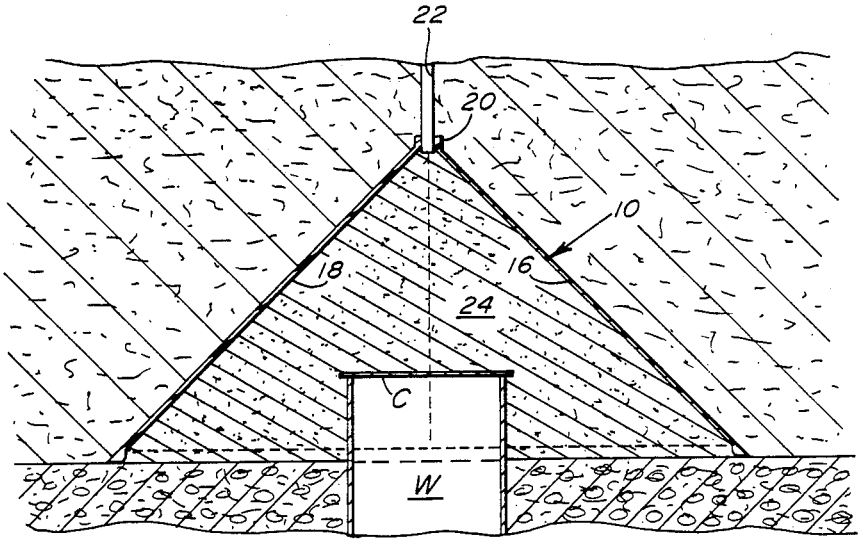
FIG. 1B shows, in expanded scale, the lower part of the system of this invention in which the frustoconical cap surrounds the oil well casing and provides a vent pipe for venting the gases to the surface, the configuration of which is shown in FIG. 1A.

The system of this invention comprises in combination with an oil well casing of an abandoned oil well, W, which has a cap, C, closing the top thereof, a collector 10 generally in the form of a frustocone, having a connector 20 for attaching the collector to a conduit 22 which carries the collected gas to the surface and vents the collected gas at a safe distance above the surface, in the particular example, venting the gas above the roof of a house H on the surface, as shown in FIG. 1.

Obviously, the gas may be vented in a number of locations, where there is free air circulation to prevent the accumulation of flammable gases in a given area.

Figure 2:
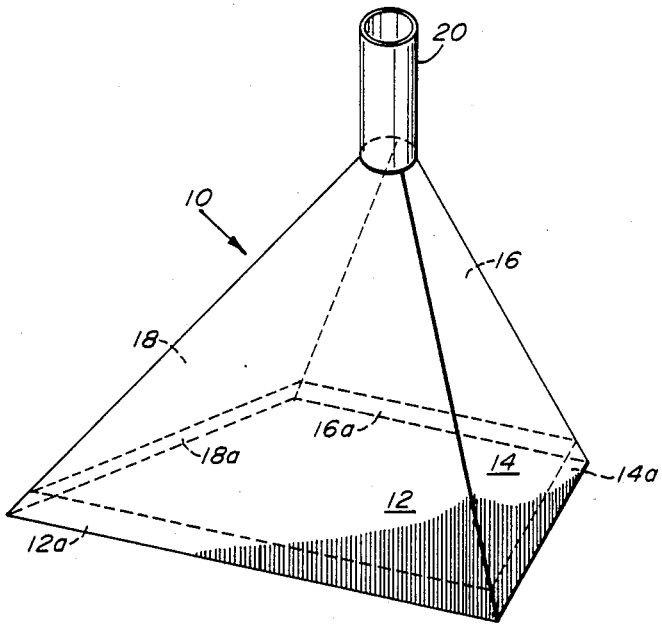
FIG. 2 is a prospective view of a cap, in one configuration, according to this invention.
Figure 3:
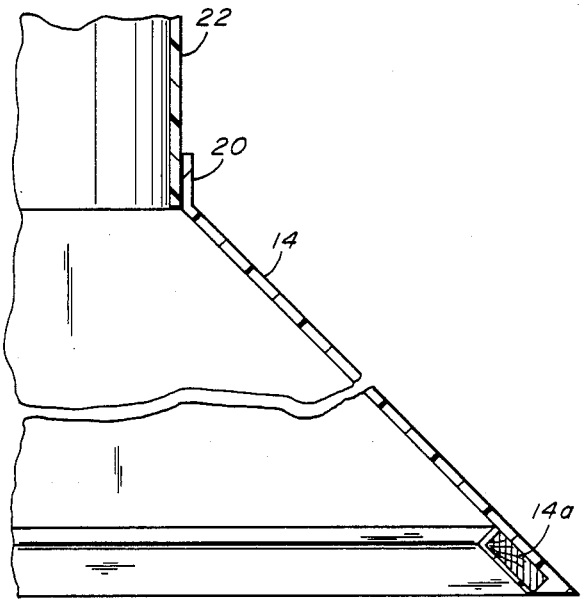
FIG. 3 is a broken partial side view of one side of the frusto-conical cap showing the detailed construction thereof.

The details of the frusto-conical collector are shown in the exemplary embodiment, in FIGS. 2 and 3. The frusto-conical structure 10 comprises, in the preferred embodiment, a generally pyramidal structure having four (4) sides but open at the bottom. The pyramidal structure is comprised of sides 12, 14, 16 and 18, the bottom edge of which is reinforced by a ridged member, such as a board or steel beam, 12A, 14A, 16A and 18A, respectively associated with sides of the same number.

Connector 20, at the top of the frusto-conical collector, is adapted to receive and seal to a conduit 22 which extends upwardly to a point of exhaust above the surface of the ground, as shown in FIG. 1A, for example.

The frusto-conical collector is filled with loose gravel indicated at 24, providing a porous mass through which the collected gas flows upwardly, and which provides long term structural support for the sides of the frusto-conical collector.

The collector is placed over and around the top of the oil well casing W, which is sealed off with a cap C. The casing may be filled with concrete plugging and may be surrounded by concrete, or may simply be capped off with a welded cap C on top of the casing W.

The invention greatly reduces the cost and very greatly increases the safety of vent systems and permits the safe construction of homes, shopping centers, business buildings, and other structures, in abandoned oil and gas fields and over other wells which may be a source of methane or other combustible or noxious gas.

It is to be clearly understood that the precise configuration of the cap is not critical to the invention, although the geometry described is highly advantageous. The frusto-conical cap may, for example, be a circular frusto-conical structure, a pyramidal or other frusto-conical structure, or any structure having a wide base converging upwardly to one or more conduit connectors to permit connection to a conduit for carrying the collected gases to the surface. While size is not crucial, an advantageous size for the collector is indicated as having a base about four (4) feet on a side and about three (3) to four (4) feet in height. Obviously, the size of the collector will depend upon the size of the area which must be collected from. Typically, a collector will be fitted over the top of one oil or gas well, but if the wells are close, or if the ground around the wells is saturated with gas, a much larger collector may be desirable. These and other variations may be made without departing from the spirit and scope of the invention.

INDUSTRIAL APPLICATION

This invention is used in the construction of buildings and homes and generally in the structural and construction industries. It may also be used in the oil well industry to provide safe venting for wells which are temporarily inactivated.

What is claimed is:

1. A capped oil or gas well comprising, in combination: the top of the well casing disposed beneath the surface of the earth; means sealing the top of the well casing; a frusto-conical collector constructed of upwardly converging walls over and surrounding the top of the well casing; a porous mass of gravel substantially filling said frusto-conical collector through which gas flows providing long-term structural support for the sides of the frusto-conical collector; and a conduit connected to and in fluid communication with the top of the frusto-conical collector extending to a point above the earth for discharging collected gases.

2. The well of claim 1 wherein the collector comprises an open-bottomed pyramidal structure having upwardly converging walls, the connecting means forming the top of the collector, and means skirting the bottom periphery forming a rigid bottom structure.

3. The capped well of claim 1 wherein the gravel has a mean diameter of about one-half to one inch.

4. The capped well of claim 3 wherein the collector comprises an open-bottomed pyramidal structure having upwardly converging walls, the connecting means forming the top of the collector, and means skirting the bottom periphery forming a rigid bottom structure.

5. A system for venting capped oil or gas wells in which the casing is capped below the surface of the earth, comprising, in combination: a frusto-conical collector constructed of upwardly converging walls over and surrounding the top of the well casing; loose gravel filling said frusto-conical collector providing long-term structural support for the sides of the frusto-conical collector; and a conduit connected to and in fluid communication with the top of the frusto-conical collector extending to a point above the earth for discharging collected gases.

6. Apparatus for venting capped oil or gas wells in which the casing is capped below the surface of the earth, comprising, in combination: a frusto-conical collector constructed of upwardly converging walls over and surrounding the top of the well casing; gravel filling said frusto-conical collector providing long-term structural support for the sides of the frusto-conical collector; a conduit for carrying the gas to be vented to a point above the earth for discharging collected gases; and means for collecting the conduit to and in fluid communication with the collector.

7. The apparatus of claim 6 wherein the collector comprises an open-bottomed pyramidal structure having upwardly converging walls, the connecting means forming the top of the collector, and means skirting the bottom periphery forming a rigid bottom structure.

* * * * *